US010559899B2

(12) United States Patent
Grenat et al.

(10) Patent No.: US 10,559,899 B2
(45) Date of Patent: Feb. 11, 2020

(54) MARKER-HOLDER DEVICE FOR A TERMINAL BLOCK

(71) Applicant: ABB SCHWEIZ AG, Baden (CH)

(72) Inventors: Gael Grenat, Shanghai (CN); André Imperato, Oullins (FR); Yannick Villardier, Mions (FR); Geoffrey Moine, Lyons (FR)

(73) Assignee: TE CONNECTIVITY SERVICES GMBH, Schaffhausen (CH)

( * ) Notice: Subject to any disclaimer, the term of this patent is extended or adjusted under 35 U.S.C. 154(b) by 0 days.

(21) Appl. No.: 16/045,294

(22) Filed: Jul. 25, 2018

(65) Prior Publication Data

US 2019/0036243 A1 Jan. 31, 2019

(30) Foreign Application Priority Data

Jul. 26, 2017 (EP) ..... 17183203

(51) Int. Cl.
*H01R 9/26* (2006.01)
*G09F 3/20* (2006.01)
*H01R 13/46* (2006.01)

(52) U.S. Cl.
CPC ..... *H01R 9/2683* (2013.01); *G09F 3/205* (2013.01); *H01R 13/465* (2013.01)

(58) Field of Classification Search
CPC ..... G09F 3/205; H01R 9/2683; H01B 7/368
USPC ..... 40/316; 439/259
See application file for complete search history.

(56) References Cited

U.S. PATENT DOCUMENTS 5,338,224 A * 8/1994 Blanke ..... H01R 9/2683 24/17 AP
5,606,813 A * 3/1997 Cornu ..... G09F 3/205 40/316
5,638,624 A 6/1997 Cornu
7,066,753 B1 * 6/2006 Tseng ..... H01R 35/02 439/259
2003/0068919 A1 * 4/2003 Martich ..... H01R 9/2683 439/488
2014/0063704 A1 * 3/2014 Neumeier ..... H02B 1/0526 361/679.01
2017/0011663 A1 * 1/2017 Hilmstedt ..... G09F 3/02
2017/0025805 A1 * 1/2017 Pizzi ..... H01R 9/2675
2017/0054231 A1 * 2/2017 Adams ..... B31D 1/02
2017/0117643 A1 * 4/2017 Pizzi ..... G09F 3/205

OTHER PUBLICATIONS

European Search Report for Application No. EP 17 18 3203.

* cited by examiner

*Primary Examiner* — Joanne Silbermann
(74) *Attorney, Agent, or Firm* — Cantor Colburn LLP

(57) ABSTRACT

A marker-holder system for an electrical terminal block comprising a longitudinal marker-holder device according to a direction of extension, the marker-holder device comprising a central part with a thinned portion and a first end in the direction of extension and a second end in the direction opposite to the direction of extension, the system comprising a first fastener configured to be disposed on the terminal block, the first end and/or the second end being configured to cooperate with the first fastener in a removable manner, the thinned portion being divisible.

14 Claims, 3 Drawing Sheets

MARKER-HOLDER DEVICE FOR A TERMINAL BLOCK

CROSS REFERENCE TO RELATED APPLICATIONS

This application claims priority under 35 U.S.C. § 119 to following European Patent application no. EP17183203.3, filed on Jul. 26, 2017, the entire contents of which are incorporated herein by reference thereto.

BACKGROUND

The present invention relates to the field of electrical connection and/or bonding devices, in particular of terminal blocks; more particularly the invention concerns a marker-holder system for one or more terminal block(s), comprising one or more marker-holder device(s) for as many terminal blocks and a fastener disposed on the terminal block(s).

BRIEF SUMMARY

It is known to clip on a terminal block a device intended to receive a marker which bears a reference identical to the reference placed on a marker which is in turn clipped on an electrical cable connected to this terminal block. These known devices however do not allow using in a simple manner the same device to mark two separate elements, nor do they allow ensuring, together with the marking function, a function of protecting or closing some openings formed in the terminal block and intended to receive particular connecting elements between terminal block or cables. The configuration of these devices must further be easily adapted if necessary, in terms of dimension in particular, but also considering the existing fastening modes on the terminal blocks in use.

The invention therefore aims at providing a simple solution to all or part of these problems.

To this end, the present invention concerns a marker-holder system for electrical terminal block comprising a longitudinal marker-holder device according to a direction of extension, the marker-holder device comprising a central part with a thinned portion and a first end in the direction of extension and a second end in the direction opposite to the direction of extension, the system comprising a first fastener configured to be disposed on the terminal block, the first end and/or the second end being configured to cooperate with the first fastener in a removable manner, the thinned portion being divisible.

Thanks to the thinned portion of the central part of the marker-holder device, the marker-holder device is divisible into two parts, each part can then be used independently of the other part as a marker-holder device according to the invention.

According to one aspect of the invention, the first end and/or the second end is/are configured to cooperate with the first fastener according to a rotary connection, between a first position in which a first face of the marker-holder device is oriented towards the terminal block and a second face of the marker-holder device is oriented in a direction opposite to the terminal block, and a second position in which the first face of the marker-holder device is oriented in a direction opposite to the terminal block and the second face of the marker-holder device is oriented towards the terminal block.

Thanks to these provisions, it is possible to use in a simple manner the same device to bear a different marker on the first face and on the second face. These markers will be alternately visible in the first or in the second position.

According to one aspect of the invention, an opening or a connecting element of the terminal block is at least partly covered by the marker-holder device in one of the two positions, while the opening or the connecting element of the terminal block is uncovered when the marker-holder device is in the other position.

Thanks to these provisions, the device allows ensuring, together with the marking function, a function of protecting or closing some openings formed in the terminal block and intended to receive particular connecting elements between terminal block or cables.

According to one aspect of the invention, a second fastener is configured to be disposed on the terminal block, the first end being configured to cooperate with the first fastener and the second end being configured to cooperate with the second fastener.

Thanks to these provisions, the device can be fastened by its two ends, in a removable manner, in the first or second position. When the two ends of the device are fastened, it is no longer movable in rotation.

According to one aspect of the invention, the first end and/or the second end comprise(s) a cylindrical portion which is longitudinal along an axis transverse to the direction of extension, forcibly inserted into the at least one fastener and movable in rotation about the axis.

Thanks to these provisions, the device is adapted to the fasteners existing on the terminal blocks in use.

The invention also relates to an arrangement of a plurality of marker-holder systems according to the invention for a plurality of terminal blocks, each marker-holder system of the plurality of marker-holder systems comprising a marker-holder device and the fastener(s) configured to be disposed on a corresponding terminal block of the plurality of terminal blocks, the marker-holder devices of the plurality of marker-holder systems being aligned according to a direction transverse to the direction of extension of one of the devices, each marker-holder device being securely attached to the marker-holder devices located on either side of this marker-holder device, and the fastener(s) disposed on the terminal block being correspondingly aligned with the alignment of the first or second end of the marker-holder devices.

BRIEF DESCRIPTION OF THE FIGURES

For a good understanding thereof, the invention is described with reference to the attached drawings showing, by way of non-limiting example, an embodiment of a device according to the invention.

DETAILED DESCRIPTION

The invention concerns a marker-holder system for a terminal block, comprising a marker-holder device 1 for a terminal block 11 and a fastener 12 disposed on the terminal block 11.

Figure 1:
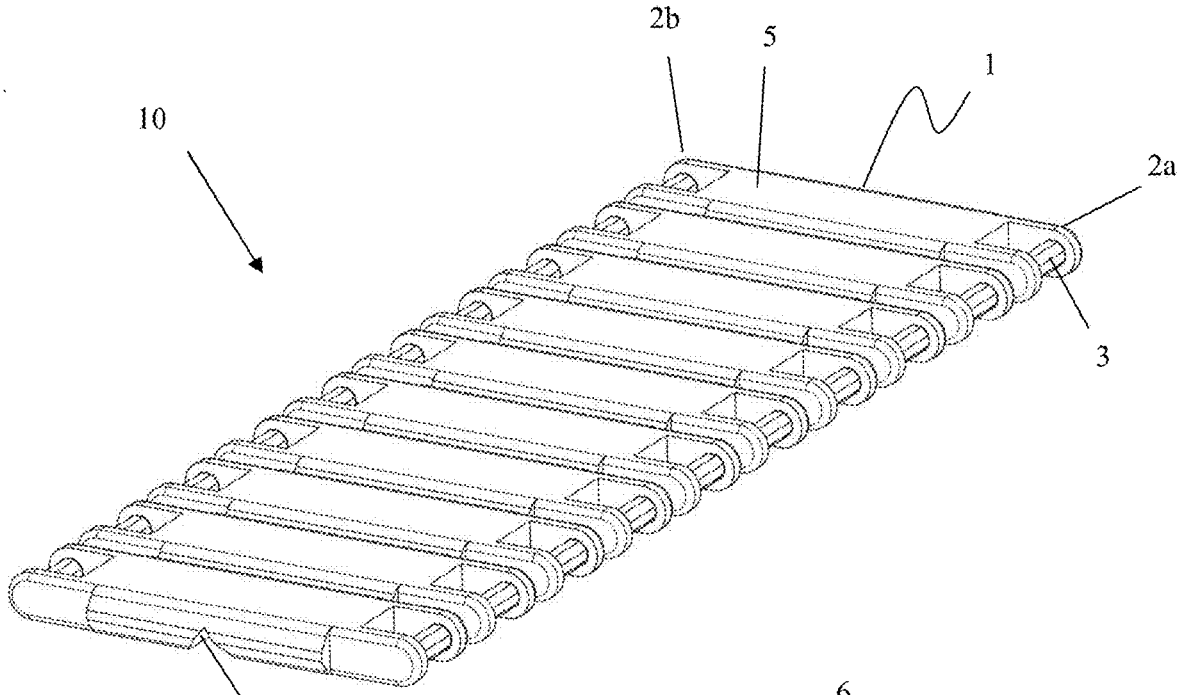
FIG. 1 is a perspective view of a linear arrangement of aligned marker holder devices.
Figure 2:
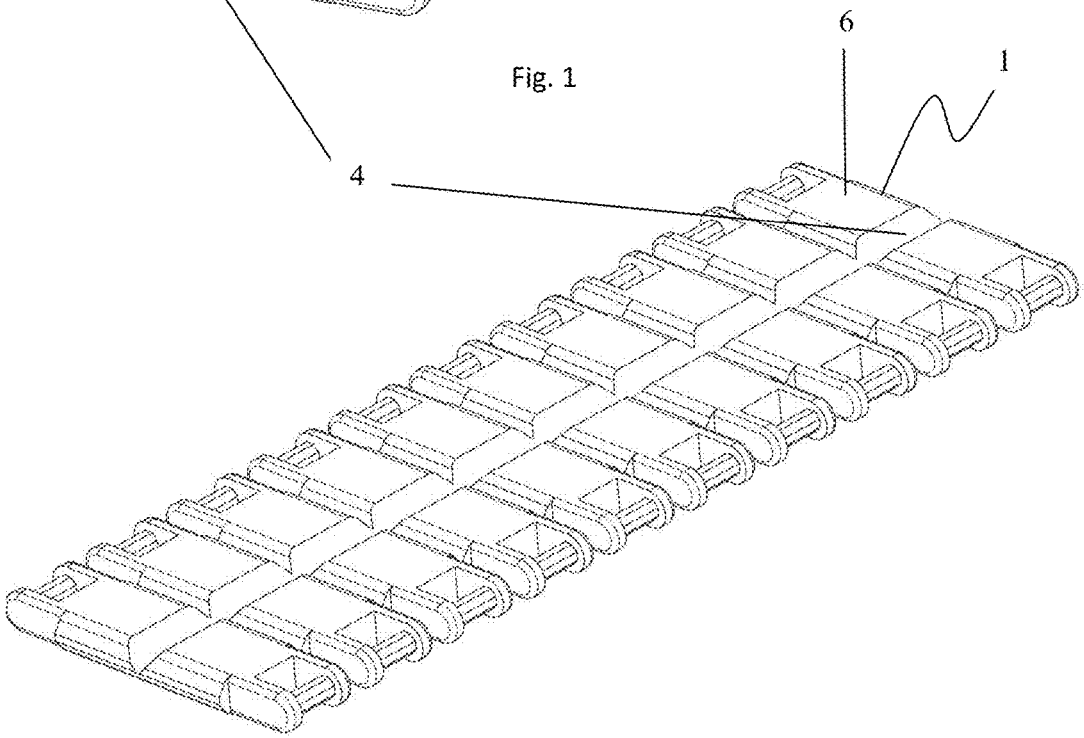
FIG. 2 is a perspective view of the arrangement of FIG. 1, with a view on the opposite face.
Figures 3A, 3B:
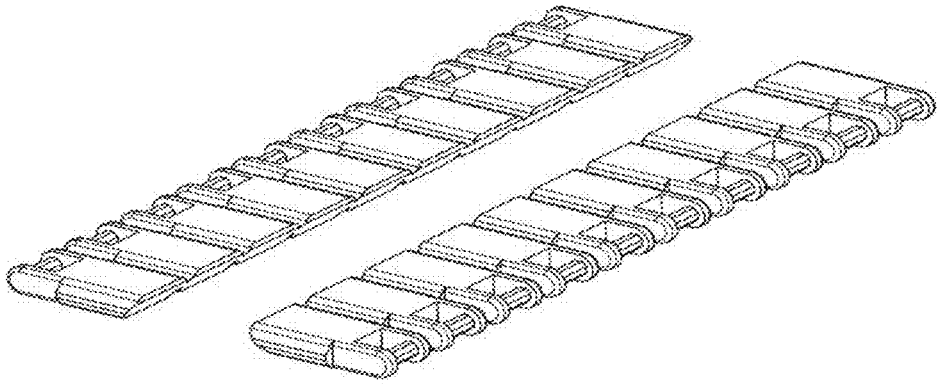
FIGS. 3*a* and 3*b* are views of the arrangement shown in FIGS. 1 and 2, after it has been separated into two parts.

FIG. 1 is a perspective view of a linear arrangement 10 comprising ten marker-holder devices 1 aligned edge-to-edge and made, in one piece, of an electrically insulating material. Each marker-holder device 1 is detachable from the linear arrangement 10, and can be used individually, independently of the other marker-holder devices 1 of the arrangement 10.

Figure 4:
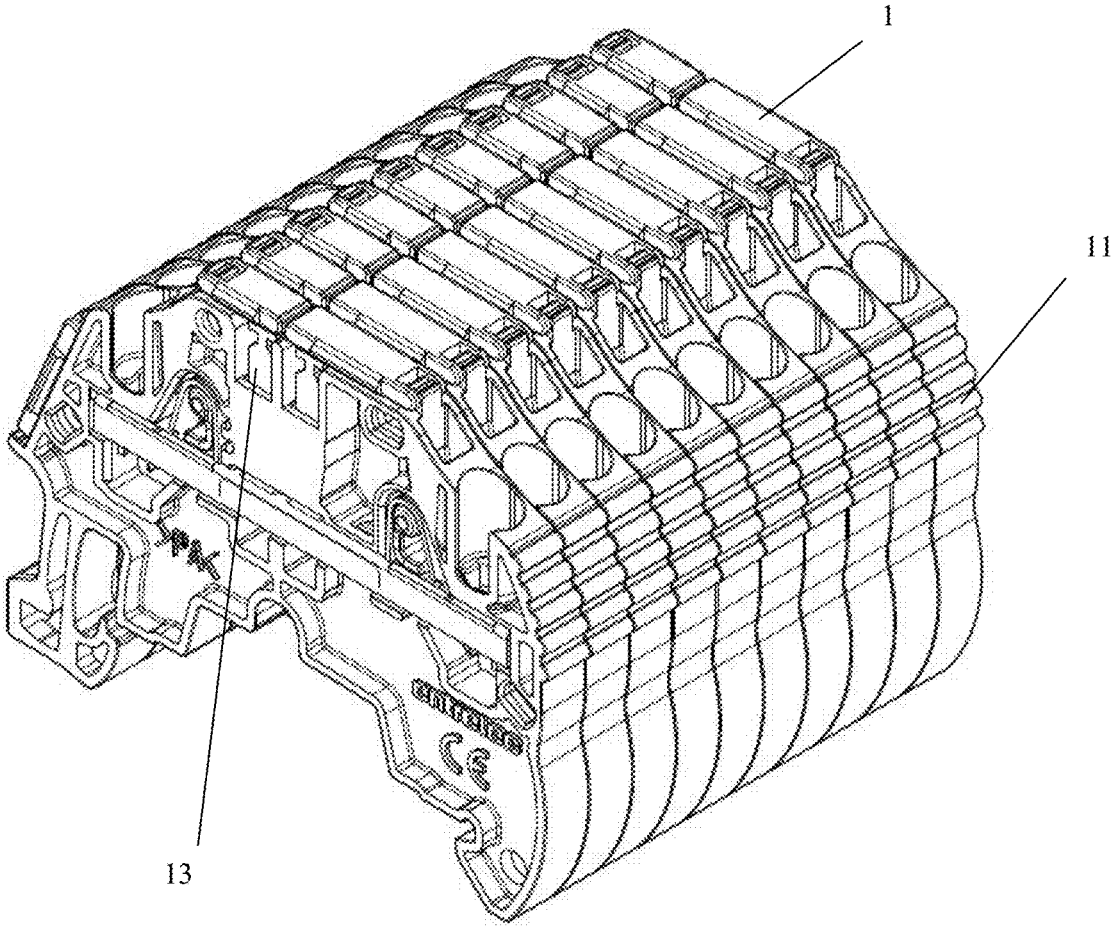
FIG. 4 is a perspective view of a terminal block, equipped with several linear arrangements of marker-holder devices, all in closed position.
Figure 5:
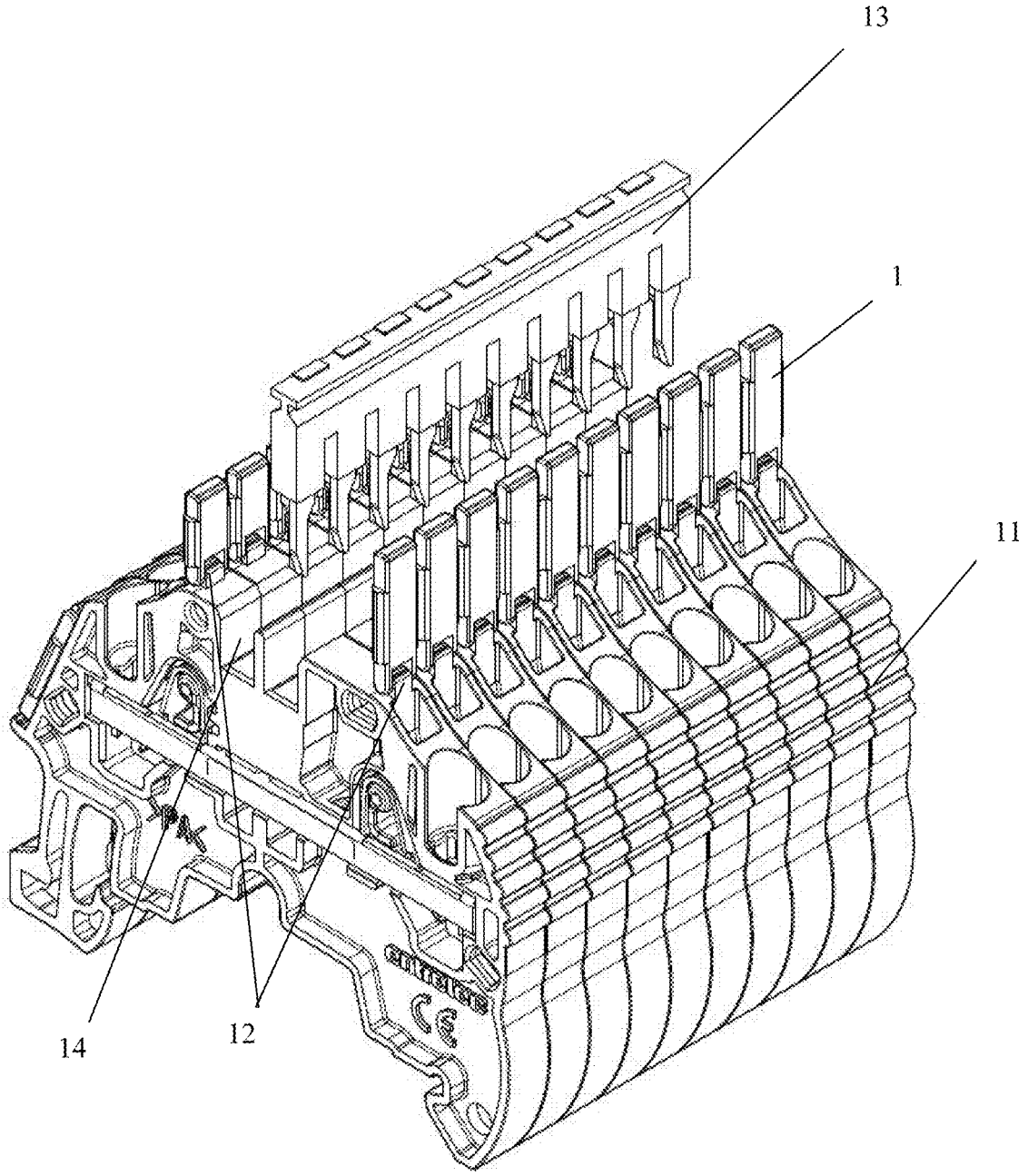
FIG. 5 is a perspective view of a terminal block, equipped with several linear arrangements of marker-holder devices, in open position.

Each device is intended to be fastened to an electrical terminal block 11. FIGS. 4 and 5 show a set of ten terminal blocks 11, mounted side by side. Each terminal block 11 can be detached from the set and can be used individually, independently of the other terminal blocks of the set. Each terminal block comprises one part made of insulating material.

At least one fastener 12 is disposed on the insulating material part of each terminal block, as shown in FIG. 5. The fastener 12 is intended to receive forcibly a complementary element 3 located at one of the ends 2*a*, 2*b* of the marker-holder device. The marker-holder device 1 has a central part of a substantially parallelepipedal shape, elongated according to a direction of extension. The complementary element 3 is, in the embodiment described here, an elongate cylinder in a direction transverse to the direction of extension of the marker-holder device 1. The cylinder is maintained between two extensions of the central part of the marker-holder device, located at one end 2*a* in the direction of extension and/or at the other end 2*b* in the direction opposite to the direction of extension of the marker-holder device.

The central part of the marker-holder 1 has two opposite faces 5, 6 onto which can be added a marker or a label bearing an appropriate reference.

When the cylindrical element 3, located at the end 2*a* or 2*b* of the marker-holder device 1, is forcibly inserted into a fastener 12 disposed on the terminal block 11, then the marker-holder device 1 is attached, in a removable manner, to the terminal block 11, and is movable in rotation about the axis of the cylindrical element 3, so that it can take a first position in which a first face 5 of the marker-holder device 1 is oriented towards the terminal block 11 and a second face 6 of the marker-holder device 1 is oriented in a direction opposite to the terminal block, or a second position in which the first face 5 of the marker-holder device 1 is oriented in a direction opposite to the terminal block and the second face 6 of the marker-holder device 1 is oriented towards the terminal block 11. It is thus possible to use in a simple manner the same device for bearing a different marker on the first face and on the second face. These two markers will be alternately visible in the first or in the second position.

According to a second use of the marker-holder device 1, this device can close, in one of its two positions, an opening 14 arranged in the terminal block 11, and when the opening 14 is to receive, in accordance with its destination, a connecting element or a withdrawable connector 13, the marker-holder device 1 can open, as illustrated in FIG. 5, to let pass the connecting element or the withdrawable connector 13, then close again to cover and protect this connecting element or this withdrawable connector 13 after its insertion into the opening 14, as illustrated in FIG. 4.

The marker-holder device 1 illustrated in FIG. 1 can be fastened by these two ends 2*a* and 2*b* simultaneously on the terminal block 11, provided that the latter is equipped with two fasteners 12 corresponding to the cylindrical elements 3 located at each end 2*a* and 2*b*. In this case, the marker-holder device 1 is no longer movable in rotation.

According to a variant of the marker-holder device 1, this device includes, at its central part, a thinned portion 4 located between the two ends 2*a* and 2*b* of the marker-holder device 1, so that the marker-holder device 1 is divisible in two parts, each part can then become a marker-holder device, however with a dimension according to the direction of extension which is shorter than that of the initial marker-holder device 1. Each marker-holder device resulting from this separation into two parts is then provided with a single end that can be fastened to the terminal block according to a rotary connection similar to that described above for the marker-holder device 1 according to the first embodiment.

As indicated in FIGS. 4 and 5, the marker-holder devices can be used not only individually but also grouped according to linear arrangements 10 that can gather an undetermined number of marker-holder devices 1, and intended to be mounted on as many corresponding terminal blocks gathered together. The invention therefore also concerns an arrangement 10 of a plurality of marker-holder systems according to any of the variants described above, for a plurality of terminal blocks, each marker-holder system of the plurality of marker-holder systems comprising a marker-holder device 1 and the fastener(s) 12 configured to be disposed on a corresponding terminal block 11 of the plurality of terminal blocks; the marker-holder devices 1 of the plurality of marker-holder systems being aligned according to a direction transverse to the direction of extension of one of the devices, each marker-holder device 1 being securely attached to the neighboring marker-holder devices 1 located on either side of this marker holder device 1; the fastener(s) 12 disposed on the terminal block being correspondingly aligned with the alignment of the ends 2*a* or ends 2*b* of the marker-holder devices 1.

What is claimed is:

1. A marker-holder system for an electrical terminal block comprising a longitudinal marker-holder device according to a direction of extension, the marker-holder device comprising a central part with a thinned portion and a first end in the direction of extension and a second end in the direction opposite to the direction of extension, the system comprising a first fastener disposed on the terminal block, the first end and/or the second end of the marker-holder device being rotatably secured to the first fastener in a removable manner so that the marker-holder device rotates between a first position in which a first face of the marker-holder device is oriented towards the terminal block and a second face of the marker-holder device is oriented in a direction opposite to the terminal block, and a second position in which the first face of the marker-holder device is oriented in a direction opposite to the terminal block and the second face of the marker-holder device is oriented towards the terminal block, so that a first marker positioned on the first face will be visible in the second position, and a second marker positioned on the second face will be visible in the first position, when the marker-holder device is rotatably secured to the first fastener, and wherein the thinned portion is divisible.

2. The marker-holder system according to claim 1, wherein an opening or a connecting element of the terminal block is at least partly covered by the marker-holder device when it is in one of the first position or the second position, and wherein the opening or the connecting element of the terminal block is uncovered when the marker-holder device is in the other of the first position or the second position.

3. The marker-holder system according to claim 2, wherein a second fastener is disposed on the terminal block, the first end being rotatably secured to the first fastener in a removable manner and the second end being rotatably secured to the second fastener in a removable manner.

4. The marker-holder system according to claim 2, wherein the first end and/or the second end comprise(s) a cylindrical portion which is longitudinal along an axis transverse to the direction of extension, and the cylindrical portion is forcibly inserted into the first fastener and the cylindrical portion is movable in rotation about the axis.

5. The marker-holder system according to claim 1, wherein a second fastener is disposed on the terminal block, the first end being rotatably secured to the first fastener in a removable manner and the second end being rotatably secured to the second fastener in a removable manner.

6. The marker-holder system according to claim 5, wherein the first end and/or the second end comprise(s) a cylindrical portion which is longitudinal along an axis transverse to the direction of extension, and the cylindrical portion is forcibly inserted into the first fastener and the cylindrical portion is movable in rotation about the axis.

7. The marker-holder system according to claim 1, wherein the first end and/or the second end comprise(s) a cylindrical portion which is longitudinal along an axis transverse to the direction of extension, the cylindrical portion is forcibly inserted into the first fastener the cylindrical portion is movable in rotation about the axis.

8. An arrangement of a plurality of marker-holder systems according to claim 1 for a plurality of terminal blocks, each marker-holder system of the plurality of marker-holder systems comprising the marker holder device and the first fastener disposed on a corresponding block terminal of the plurality of terminal blocks, the marker-holder devices of the plurality of marker-holder systems being aligned according to a direction transverse to the direction of extension of one of the devices, each marker-holder device being rotatably secured to a respective first fastener disposed on the terminal block and being correspondingly aligned with the alignment of the first end or the second end of the marker-holder devices.

9. The arrangement of claim 8, wherein an opening or a connecting element of the terminal block is at least partly covered by the marker-holder device when it is in one of the first position and the second position, while the opening or the connecting element of the terminal block is uncovered when the marker-holder device is in the other of the first position and the second position.

10. The arrangement of claim 9, wherein a second fastener is disposed on the terminal block, the first end rotatably secured to the first fastener and the second end rotatably secured to the second fastener.

11. The arrangement of claim 9, wherein the first end and/or the second end comprise(s) a cylindrical portion which is longitudinal along an axis transverse to the direction of extension, and the cylindrical portion is forcibly inserted into the first fastener and the cylindrical portion is movable in rotation about the axis.

12. The arrangement of claim 8, wherein a second fastener is disposed on the terminal block, the first end being rotatably secured to the first fastener and the second end being rotatably secured to the second fastener.

13. The arrangement of claim 12, wherein the first end and/or the second end comprise(s) a cylindrical portion which is longitudinal along an axis transverse to the direction of extension, and the cylindrical portion is forcibly inserted into the first fastener and the cylindrical portion is movable in rotation about the axis.

14. The arrangement of claim 8, wherein the first end and/or the second end comprise(s) a cylindrical portion which is longitudinal along an axis transverse to the direction of extension, and the cylindrical portion is forcibly inserted into the first fastener and the cylindrical portion is movable in rotation about the axis.

* * * * *